US007692518B2

(12) United States Patent
McKay

(10) Patent No.: US 7,692,518 B2
(45) Date of Patent: Apr. 6, 2010

(54) COMPACT BROADBAND NON-CONTACTING TRANSMISSION LINE JUNCTION HAVING INTER-FITTED ELEMENTS

(75) Inventor: James P. McKay, Hermosa Beach, CA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 11/825,494

(22) Filed: Jul. 6, 2007

(65) Prior Publication Data

US 2009/0009271 A1 Jan. 8, 2009

(51) Int. Cl.
*H01P 5/02* (2006.01)
*H01P 1/04* (2006.01)

(52) U.S. Cl. ..... 333/245; 333/34

(58) Field of Classification Search ..... 333/245, 333/34

See application file for complete search history.

(56) References Cited

U.S. PATENT DOCUMENTS

| | | | | | |
|---|---|---|---|---|---|
| 2,451,876 | A * | 10/1948 | Salisbury | 333/260 |
| 3,970,969 | A * | 7/1976 | Sirel et al. | 333/12 |
| 4,677,405 | A * | 6/1987 | Gray | 333/245 |
| 5,120,705 | A * | 6/1992 | Davidson et al. | 505/220 |
| 6,392,510 | B2 * | 5/2002 | Gregorwich | 333/245 |

* cited by examiner

*Primary Examiner*—Benny Lee
(74) *Attorney, Agent, or Firm*—Sutherland Asbill & Brennan LLP

(57) ABSTRACT

A transmission line junction for a coaxial conductor line has mating ends of interfitting cores, sleeves, and dielectrics for communicating broadband signals through the junction that blocks DC currents and voltages, the junction maintaining a quarter wavelength junction length for high frequency coupling while providing improved low frequency coupling across the junction.

20 Claims, 4 Drawing Sheets

MULTIPLE SLEEVE BROADBAND DC BLOCK JUNCTION (PRIOR ART)
SINGLE SLEEVE BROADBAND DC BLOCK JUNCTION

MULTIPLE SLEEVE BROADBAND DC BLOCK JUNCTION

VARIABLE IMPEDANCE MULTIPLE SLEEVE BROADBAND DC BLOCK JUNCTION

MULTIPLE SLEEVE DC BLOCK JUNCTION TRANSMISSION LINE ANALYTICAL MODEL

SLEEVE STEP IMPEDANCE

REFLECTION LOSS PERFORMANCE

COMPACT BROADBAND NON-CONTACTING TRANSMISSION LINE JUNCTION HAVING INTER-FITTED ELEMENTS

STATEMENT OF GOVERNMENT INTEREST

The invention was made with Government support under contract No. FA8802-04-C-0001 by the Department of the Air Force. The Government has certain rights in the invention.

FIELD OF THE INVENTION

The invention relates to the field of DC blocks and non-contacting junctions required for elimination of passive intermodulation (PIM) generation. More particularly, the present invention relates to broadband DC block or PIM-free junctions for AC coupling broadband signals across the DC blocking or PIM-free junctions.

BACKGROUND OF THE INVENTION

A drawing of a prior art DC block junction is shown in FIG. 1. Referring to FIG. 1, a prior art coaxial line junction, which will here be referred to as a single sleeve broadband DC block, may be employed in a microwave circuit when transmission of alternating currents (AC) is to be allowed but transmission of direct currents (DC) is to be prevented and blocked. The junction is used in coaxial cables having an outer conductor that is typically grounded and having an outer dielectric. The inner conductor is severed in two at the DC block forming a first inner conductor and a second inner conductor. For purposes of distinction, the prior art junction is characterized as having a first inner conductor with a protruding core and having a second inner conductor with a protruding sleeve. The core and sleeve interfit together. Between the core and the sleeve is an inner dielectric that separates the first and second inner conductor forming a capacitive DC block at the junction. The core is inserted inside the sleeve. Hence, the two inner conductors capacitively couple together with the core being inserted into the sleeve a distance L that is typically chosen to be one-quarter wavelength ($L=\lambda/4$) in order to obtain broadband performance.

At low frequencies, the requirement for a one-quarter wavelength coupling section and small junction length cannot be satisfied without using a high dielectric constant material in the coupling region, and therefore requires a trade-off between large size and relatively high insertion loss. This trade-off is highly undesirable for satellite and other space applications in which minimization of mass and insertion loss are critical. These and other disadvantages are solved or reduced using the invention.

SUMMARY OF THE INVENTION

An object of the invention is to provide a DC block junction blocking DC signals, preventing metal-to-metal contact of inner conductors, and coupling AC signals Another object of the invention is to provide a DC block junction blocking DC signals, preventing metal-to-metal contact of inner conductors, and coupling AC signals with the physical junction length being equal to or less than a quarter wavelength of a communicated AC signal.

Yet another object of the invention is to provide DC block junction blocking DC signals, preventing metal-to-metal contact of inner conductors, and coupling AC signals with the junction having interfitting cores and sleeves separated by dielectrics.

Still another object of the invention is to provide DC block junction blocking DC signals, preventing metal-to-metal contact of inner conductors, and coupling AC signals with the junction having interfitting cores and sleeves separated by dielectrics, the sleeves being stepped to provide AC coupling over a predetermined broad bandwidth.

The invention is a DC block junction having a plurality of interfitting non-contacting opposing axial flanges. The flanges are designated as cores and sleeves where the cores are disposed in and surrounded by the sleeves. A serpentine dielectric is extended between the cores and sleeves. The serpentine dielectric is made using a plurality of dielectrics disposed between juxtaposed interfitting cores and sleeves. The sleeves may further be stepped, notched, or otherwise irregularly shaped sleeves to precisely control the broadband frequency response. The junction provides high low-frequency rejection while passing a broadband signal within a predetermined center frequency and passband. These and other advantages will become more apparent from the following detailed description of the preferred embodiment.

DETAILED DESCRIPTION OF THE PREFERRED EMBODIMENT

Figure 1:
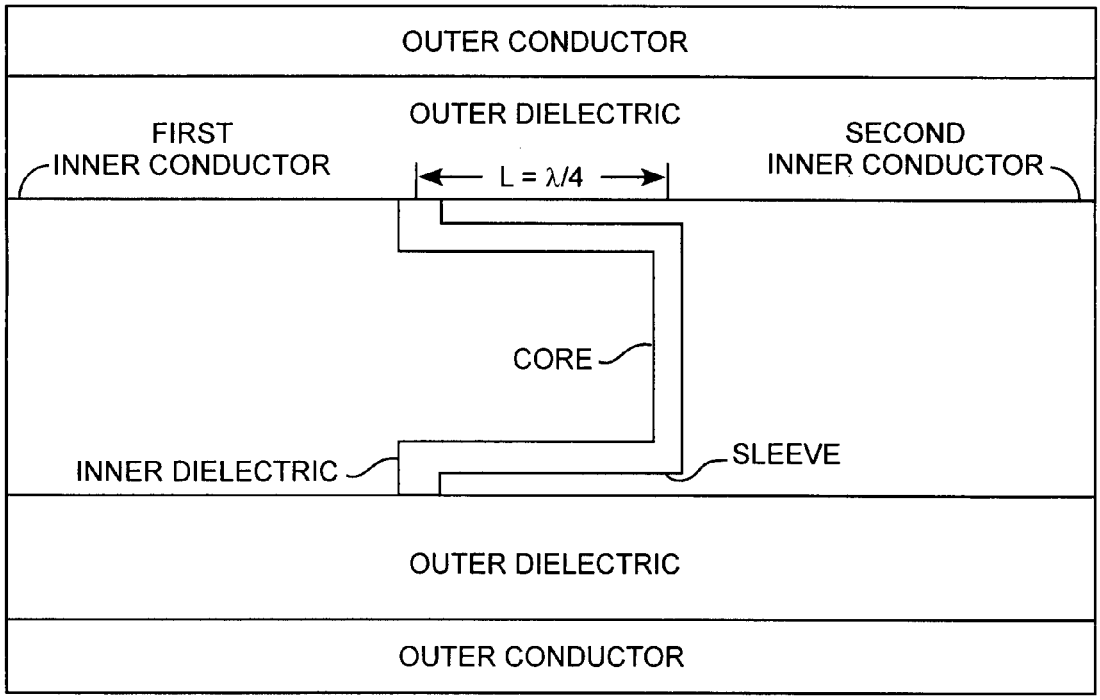
FIG. 1 is a diagram of a prior art DC block, referred to as a single sleeve broadband DC block junction.
Figure 2:
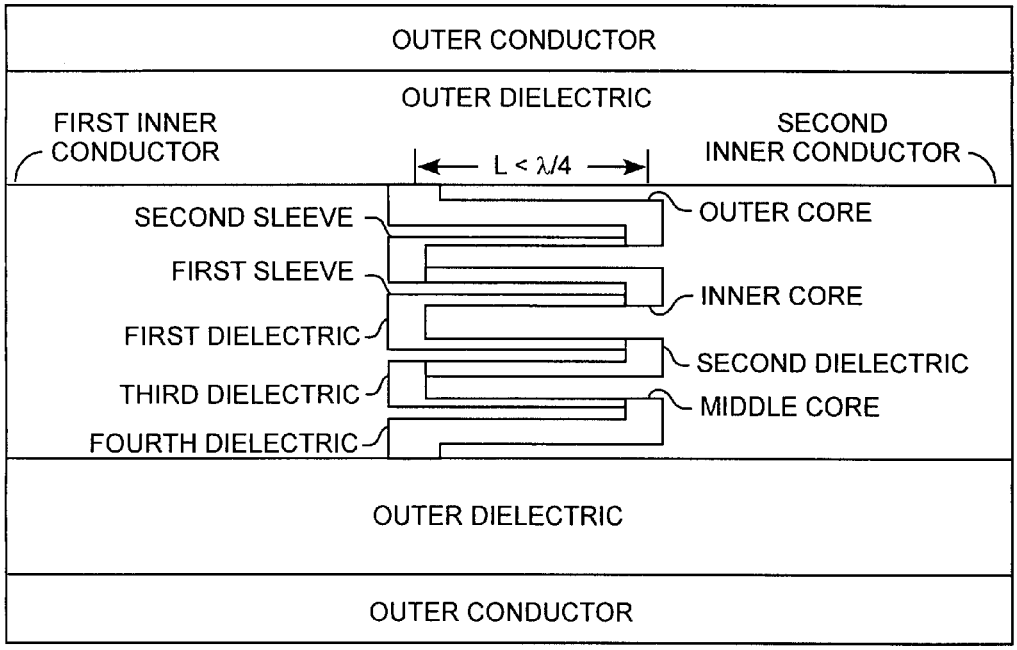
FIG. 2 is a diagram of a multiple sleeve broadband DC block junction.

An embodiment of the invention is described with reference to the figures using reference designations as shown in the figures. Referring to FIG. 2, a multiple sleeve broadband DC block junction has a junction, which maintains the maximum $\lambda/4$ length L where $L<\lambda/4$ along a coaxial cable having a grounded outer conductor, an outer dielectric, and an inner conductor separated into a first inner conductor and a second inner conductor. The first inner conductor includes a first sleeve and a second sleeve. The second inner conductor includes an inner core, a middle core, and an outer core. As shown, the inner core interfits inside the first sleeve separated by a first dielectric. The first sleeve interfits inside the middle core separated by a second dielectric. The middle core interfits into a second sleeve separated by a third dielectric. Finally, the second sleeve interfits into an outer core separate by a fourth dielectric. As such, the cores, sleeves, and dielectric are interfitting, and the cores and sleeves interfit within each other. The cores and sleeves can be viewed as interfitting concentric flanges each commonly characterized as having an outer circular surface interfitting within an inner circular surface of a surrounding juxtaposed flange, excepting of course, the outer flange, be it designated as a core or as a sleeve. Each of the flange ends are tube-like ends, excepting the very inner core, which is preferably a rod extending into a mating surrounding a juxtaposed sleeve. This preferred form of the DC block junction is further characterized as a three-core, two-sleeve, and four-dielectric DC block junction.

Figure 3:
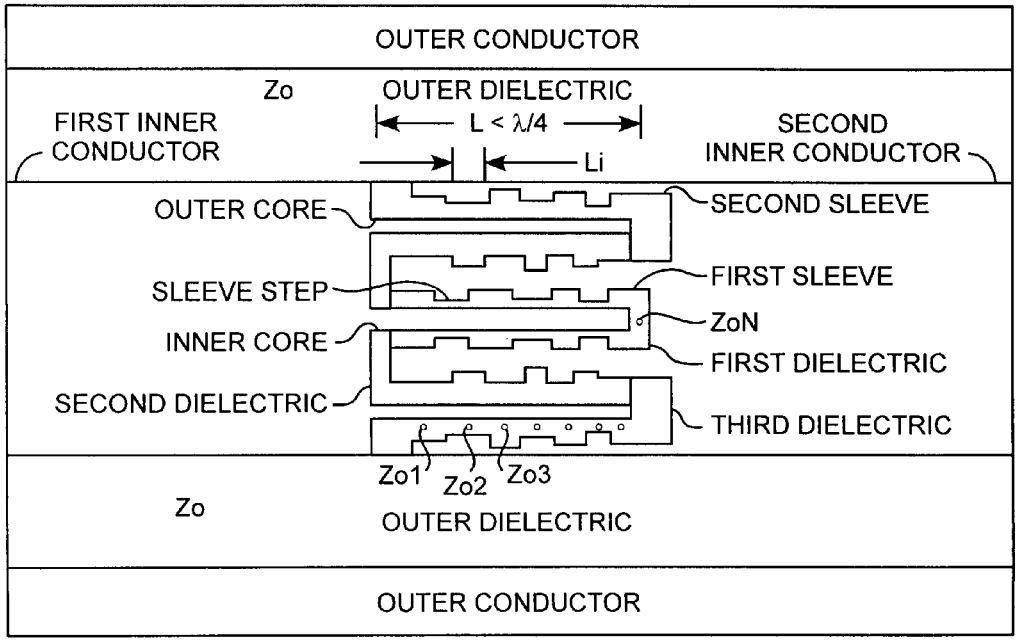
FIG. 3 is a diagram of a variable impedance multiple sleeve broadband DC block junction.

Referring to FIG. 3, a variable impedance sleeve broadband DC block junction also has a junction which maintains the maximum $\lambda/4$ length L where $L<\lambda/4$ along a coaxial cable having a grounded outer conductor, an outer dielectric having an impedance Zo, and an inner conductor separated into a first inner conductor and a second inner conductor. The first inner conductor includes an inner core and an outer core. The second inner conductor includes a first sleeve and a second sleeve. As shown, the inner core interfits inside the first sleeve separated by a first dielectric, the first sleeve interfits inside the outer core separated by a second dielectric, and finally, the outer core interfits into a second sleeve separated by a third dielectric. As such, the cores, sleeves, and dielectrics are interfitting, and the cores and sleeves interfit within each other. This form of the DC block junction is further characterized as a two-core, two-sleeve, and three-dielectric DC block junction. Typically, the numerical difference between the number of cores and the number sleeves can be one, zero, and minus one. The sum of the number of cores and the number of sleeves is greater than two. The number of dielectrics between the cores and sleeves is that sum minus one.

The variable impedance sleeve broadband DC block junction may further include stepped sleeves. The stepped sleeves are stepped to affect and tailor the impedance across junction for fine tuning the DC block junction to a particular bandpass profile. The steps may have length Li, only one of which lengths of the steps being referenced as such for convenience, where i is a step index from one to N. As shown, there is a first model impedance ZoN extending from the inner core of the first inner conductor, through the first dielectric, to the second inner conductor. As further shown, there are three steps in the second sleeve, which is an outer sleeve. This second sleeve has respective modeled impedances Zo1, Zo2, Zo3 at the three steps designated by such. These ZoN designations represent modeled impedances across a dielectric at the various steps in the sleeves. The ZoN designations apply for each of the steps of all of the sleeves along the serpentine dielectric between the cores and sleeves. As shown, the steps are embedded in the sleeves, but could as well be disposed along the cores, or both, in a variety of lengths and depths into the sleeves and cores.

Figure 4:
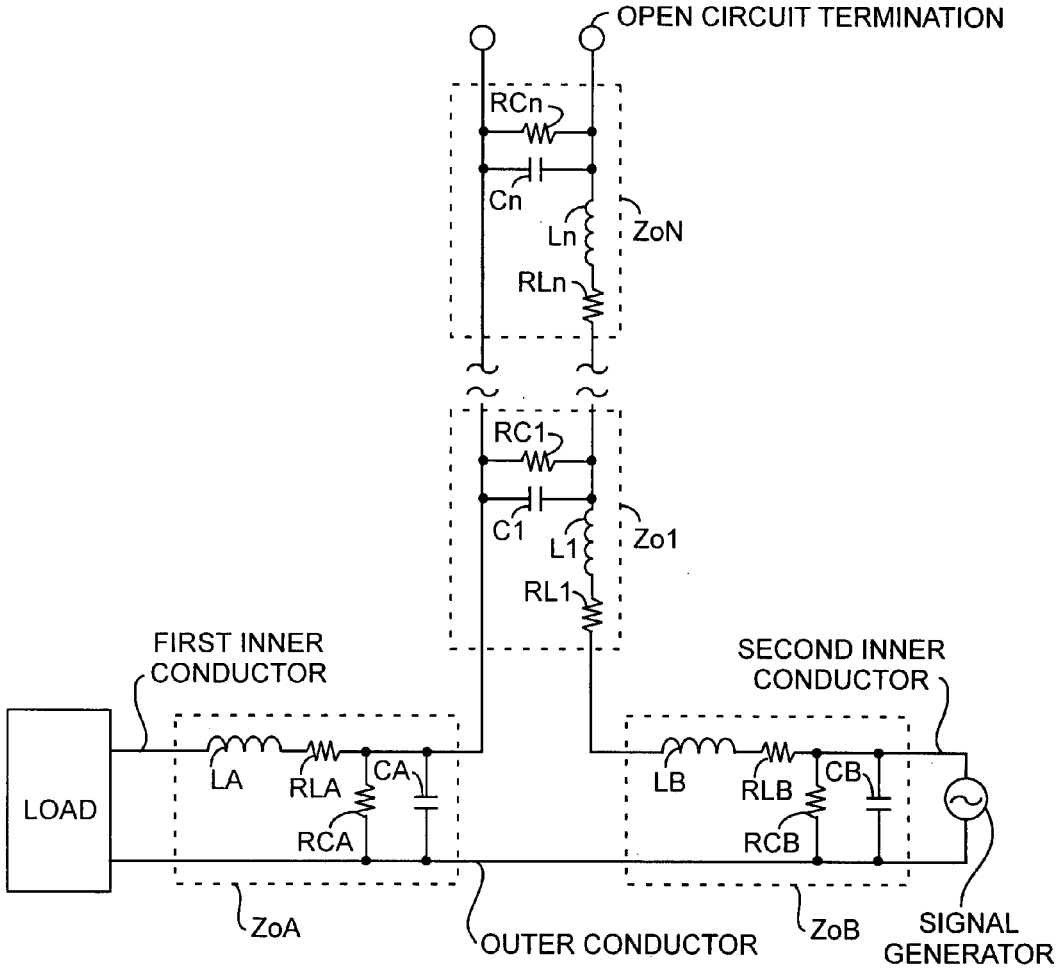
FIG. 4 is a schematic analytical model of a multiple sleeve DC block junction transmission line.
Figure 5:
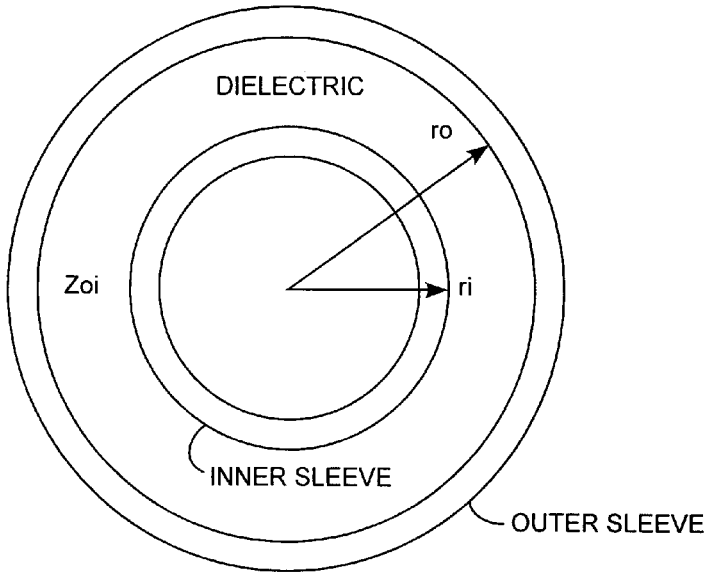
FIG. 5 is a diagram showing a cross section of a sleeve step impedance.
Figure 6:
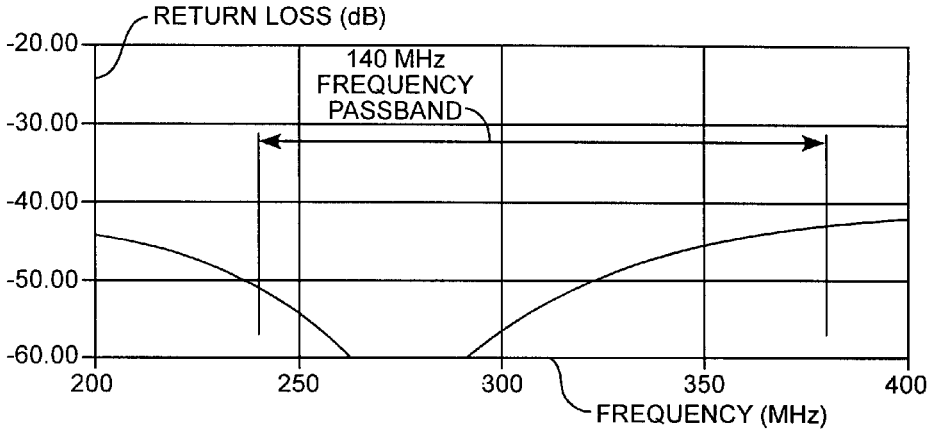
FIG. 6 is a reflection loss performance graph.

Referring to all of the Figures, and more particularly to FIGS. 4 through 6, a variable impedance sleeve broadband DC block junction with steps can be modeled using conventional modeling and simulation methods for performance verification. The multiple sleeve DC block junction transmission line analytical model, as best shown in FIG. 4, uses a signal generator for providing a signal transmitted from the second inner conductor to the first inner conductor that is in turn connected to a load. The first conductor is modeled using a model ZoA having an inductor LA, a capacitor CA, a resistor RLA, and a resistor RCA. The second conductor is model using a model ZoB having an inductor LB, a capacitor CB, a resistor RLB, and a resistor RCB. The model ZoA and model ZoB are connected by the outer conductor. The junction is modeled using a series of like models from a first step to an n-th step for each step in the sleeves or cores. The first step has a impedance Zo1 with a first capacitor C1, a first inductor L1, a first capacitor resistor RC1 and a first inductor resistor RL1. Likewise, the last step has a impedance ZoN modeled using a last capacitor Cn, a last inductor Ln, a last capacitor resistor RCn and a last inductor resistor RLn. The last impedance ZoN is terminated by an open circuit termination. The analytical model for a block junction is well known, but adapted for the step sleeve configuration. FIG. 5 shows a sleeve step as having a dielectric with an impedance Zoi that is modeled using two radii ri for an inner sleeve and ro for an outer sleeve, though, either one of which could be a core. The modeling of the block junction allows for the simulation of performance results as shown in FIG. 6. The DC block junction with multiple sleeves and cores has a broadband frequency passband of 140 MHz with reduced return losses having both the low frequencies and the high frequencies. As shown, the return loss decreases between 250 MHz and 300 MHz where the return loss is desirably low for improved signal transmission.

The selectable transmission line characteristic impedances and lengths are adjusted to optimize performance for the desired frequency band. The characteristic impedances may be adjusted by adjusting the radial gaps in a coaxial geometry in the regions between inner conductors of cores and sleeves, or by changing the dielectric constants of the materials in dielectrics, or by changing both. Additionally, these variables associated with the selectable transmission line characteristic impedances and lengths provide flexibility in choosing a physical layout that is compatible with the available cross-sectional area of the inner conductor. The impedances and lengths are also compatible with other typical electrical performance requirements such as avoidance of breakdown and corona, and with typical thermal or mechanical stress requirements such as minimum thickness of dielectric and conductive materials.

Although a coaxial geometry is shown in FIGS. 2, 3, and 5, the cross-sections of the two main transmission lines or interior selectable transmission lines need not be circular but can be arbitrary. There is no general requirement for the length L of the coupling section in the main transmission line. The length L of the coupling region need not be one-quarter wavelength long as in the prior art. Therefore, the multiple sleeve DC block junction generally requires a smaller length of main line than the prior art DC block for the same performance level.

A typical application of the invention is a multi-carrier satellite communication system in which a helix or other wire antenna must be connected to another microwave component without generating passive intermodulation products. Another typical application is the implementation within an electrically small volume. All of the conductor volume can be exploited for electrical performance enhancement using any series reactance required. The implementation can be used in or as a resonator, filter, matching network, DC block, bias injection circuit, or other microwave component that otherwise would require a greater length of main transmission line, or a volume external to the inner conductor of the main transmission line.

An exemplary implementation can be manufactured using conventional machine shop equipment such as a milling machine and lathe. Neglecting the shorter transmission lines, there are effectively four transmission lines having characteristic impedances $Z_{01}=Z_{03}=Z_{04}=0.8$ Ohms, and, $Z_{02}=0.25$ Ohms. The lengths of the transmission lines are $L_1=L_2=L_3=L_4=0.75$ inches. The dielectric constant of the material filling the junction regions between the two inner conductors is 9.6. The characteristic impedance of the two main transmission lines is $Z_0=50$ Ohms. The electrical performance was determined using both the ideal transmission line model and an exact high frequency structure simulator. The predicted performance over the desired frequency band was 240 MHz to 380 MHz and demonstrates extremely low return loss over the band. Air gaps of 0.002 inches at each interface of conductive and dielectric material were simulated indicating low sensitivity to typical manufacturing errors. Gross machining errors on the order of +/−0.005 inches were simulated, and the predicted return loss demonstrates that the performance is not sensitive to easily achievable machining tolerances.

The invention utilizes transmission lines interior to the inner conductors of a main transmission line in order to allow a break in the main line while simultaneously providing a broadband microwave impedance match and very low insertion loss. The components of the invention consist of a selected number of transmission lines that in general have different characteristic impedances and lengths. An advantage of the invention is that passive intermodulation effects due to a conventional low-pressure contacting transmission line junction are eliminated and extremely low insertion loss is obtained while requiring only an electrically small length of main line. Extremely low insertion loss is very important, for example, when the junction is employed in line with and near a high-power radiating antenna on a satellite.

The invention is directed to a multiple sleeve DC block junction. The junction has advantage due primarily to the increased functionality and decreased volume requirement that is achieved by utilizing all the available region inside an inner conductor of a transmission line, a region that would otherwise contain no electromagnetic fields and perform no electrical function. The junction utilizes all of the conducting area, for example, to increase the bandwidth and decrease the sensitivity to tolerances without increasing the insertion loss of a non-contacting junction required for connecting a helix or other wire antenna to another microwave component without generating passive intermodulation products.

The specific markets for the invention are providers of space and other communication systems that require minimization of passive intermodulation effects, and other providers of microwave components and microwave systems that require minimal mass, implementation volume and insertion loss. Those skilled in the art can make enhancements, improvements, and modifications to the invention, and these enhancements, improvements, and modifications may nonetheless fall within the spirit and scope of the following claims.

What is claimed is:

1. A junction for blocking DC signals and passing AC signals, the junction comprising, a first conductor having a first set of flanges, a second conductor having a second set of flanges, the first and second sets of flanges interfitting, and a plurality of dielectrics respectively disposed between juxtaposed pairs of the first and second sets of flanges, wherein the first conductor and the second conductor, when interfitted according to the first and second sets of flanges, provides an inner conductor of a transmission line.

2. The junction of claim 1 wherein, an inner most flange of the first set of flanges is in the shape of a rod, an outer most flange of the second set flanges is in the shape of a tube, and flanges at least one of the of the first set of flanges and the second set of flanges between the inner most flange and the outer most flange are in the shape of tubes.

3. The junction of claim 1 wherein, an inner most flange of the first set of flanges is in the shape of a rod, an outer most flange of the first set of flanges is in the shape of a tube, and flanges at least one of the of the first set of flanges and the second set of flanges between the inner most flange and the outer most flange are in the shape of tubes, and at least one of the flanges of the first and second set of flanges has an irregular surface for determining the impedance and frequency response of the junction between the first conductor and the second conductor.

4. The junction of claim 1 wherein, the transmission line is a coaxial cable.

5. The junction of claim 1 wherein, the number of flanges of the first set of flanges is greater than two.

6. The junction of claim 1 wherein, the length of the first and second sets of flanges is equal to or less than a quarter wavelength of an AC signal communicated through the junction.

7. The junction of claim 1, wherein the transmission line further includes an outer conductor around the inner conductor.

8. The junction of claim 1, wherein the first set of flanges comprise cores, and the second set of flanges comprise sleeves.

9. A junction for blocking DC signals and passing AC signals, the junction comprising, a first conductor having a plurality of cores, a second conductor having a plurality of sleeves, the cores and sleeves being interfitting cores and sleeves, and dielectrics disposed between the interfitting cores and sleeves, wherein the first conductor and the second conductor, when interfitted according to the cores and sleeves, provides an inner conductor of a transmission line.

10. The junction of claim 9 wherein, the number of dielectrics between the cores and sleeves is equal to the sum of the number of cores and sleeves minus one.

11. The junction of claim 9 wherein, the cores and sleeves have a respective length which is equal to or less than a quarter wavelength of an AC signal communicated through the junction.

12. The junction of claim 9 wherein, a numerical difference between the number of cores and the number of sleeves is selected from the group consisting of positive one, zero, and minus one.

13. The junction of claim 9 wherein, the sum of the number of cores and the number of sleeves is greater than two.

14. The junction of claim 9, wherein the transmission line further includes an outer conductor around the inner conductor.

15. The junction of claim 9, wherein the transmission line is a coaxial cable.

16. A junction for blocking DC signals and passing AC signals, the junction comprising, a first conductor having a plurality of first flanges, a second conductor having at least one second flange, the plurality of first flanges and the at least one second flange interfitting, and dielectrics disposed between the interfitting plurality of first flanges and the at least one second flange, wherein the first conductor and the second conductor, when interfitted according to the plurality of first flanges and at least one second flange, provides an inner conductor of a transmission line.

17. The junction of claim 16 wherein, the plurality of first flanges comprises at least two cores, and the at least one second flange comprises at least one sleeve.

18. The junction of claim 16 wherein, an innermost flange of the plurality of first flanges is in the shape of a rod, and an outermost flange of the plurality of first flanges is in the shape of a tube.

19. The junction of claim 16, wherein the at least one second flange comprises a plurality of second flanges.

20. The junction of claim 16, wherein the transmission line is a coaxial cable.

* * * * *